US008960466B2

(12) United States Patent
Golden

(10) Patent No.: US 8,960,466 B2
(45) Date of Patent: Feb. 24, 2015

(54) NOVELTY ASSOCIATED WITH STOPPERS FOR BEVERAGES

(71) Applicant: Andrew P. Golden, Jamaica Plain, MA (US)

(72) Inventor: Andrew P. Golden, Jamaica Plain, MA (US)

( * ) Notice: Subject to any disclaimer, the term of this patent is extended or adjusted under 35 U.S.C. 154(b) by 11 days.

(21) Appl. No.: 13/769,362

(22) Filed: Feb. 17, 2013

(65) Prior Publication Data

US 2013/0233821 A1 Sep. 12, 2013

Related U.S. Application Data

(63) Continuation-in-part of application No. 12/852,924, filed on Aug. 9, 2010, now Pat. No. 8,376,161.

(60) Provisional application No. 61/634,154, filed on Feb. 24, 2012, provisional application No. 61/273,850, filed on Aug. 8, 2009.

(51) Int. Cl.

| | |
|---|---|
| ***B67B 1/04*** | (2006.01) |
| ***B65D 39/00*** | (2006.01) |
| ***B65D 51/24*** | (2006.01) |
| ***B65D 51/28*** | (2006.01) |
| *B67B 1/10* | (2006.01) |

(52) U.S. Cl.

CPC ..... *B65D 39/00* (2013.01); *B65D 51/245* (2013.01); *B65D 51/2807* (2013.01)

USPC ..... 215/228; 215/364; 53/489; 220/522

(58) Field of Classification Search

USPC ..... 220/522, 521; 215/228, 364; 53/489; 40/311

See application file for complete search history.

(56) References Cited

U.S. PATENT DOCUMENTS

| | | | | | |
|---|---|---|---|---|---|
| 2,936,089 | A * | 5/1960 | Goldfarb et al. | 215/6 |
| 3,009,594 | A * | 11/1961 | Anson | 215/228 |
| 3,326,400 | A * | 6/1967 | Hamelin et al. | 206/221 |
| 5,056,681 | A * | 10/1991 | Howes | 220/522 |
| 5,117,995 | A * | 6/1992 | Kau | 215/228 |
| 5,950,819 | A * | 9/1999 | Sellars | 206/221 |
| 6,032,820 | A * | 3/2000 | Ladina et al. | 220/522 |
| 6,085,919 | A * | 7/2000 | Singer | 215/10 |
| 6,450,160 | B1 * | 9/2002 | Fu et al. | 124/57 |
| 2005/0184024 | A1 * | 8/2005 | Santa Cruz et al. | 215/227 |
| 2006/0070971 | A1 * | 4/2006 | Michalopoulos | 215/228 |
| 2009/0020535 | A1 * | 1/2009 | Joubert et al. | 220/521 |

* cited by examiner

*Primary Examiner* — Mickey Yu
*Assistant Examiner* — Niki Eloshway

(57) ABSTRACT

Systems, methods, and means for providing a novelty item are provided. In some embodiments, a stopper comprises a body, having an inner chamber and a top portion, a novelty item disposed within said inner chamber, and a cover to open after said inner chamber is removed from a neck of a bottle.

17 Claims, 8 Drawing Sheets

NOVELTY ASSOCIATED WITH STOPPERS FOR BEVERAGES

CROSS-REFERENCE TO RELATED APPLICATIONS

This application is based on, and claims benefit of and priority to, U.S. Provisional Patent Application No. 61/273,850, filed on Aug. 8, 2009, the contents of which are hereby incorporated by reference in their entirety for all purposes. This application is also based on, and claims benefit of and priority to, U.S. patent application Ser. No. 12/852,924, filed on Aug. 9, 2010, the contents of which are hereby incorporated by reference in their entirety for all purposes. This application is based on, and claims benefit of and priority to, U.S. Provisional Patent Application No. 61/634,154, filed on Feb. 24, 2012, the contents of which are hereby incorporated by reference in their entirety for all purposes.

FIELD OF THE INVENTION

The present invention relates to a device to enhance the novelty associated with a beverage. More specifically, the invention relates to enhancing the entertainment of the process of removing a stopper from a pressurized bottle.

BACKGROUND

Champagne as we know it today—the original type of sparkling wine—was invented about 300 years ago, and the association of Champagne and other sparkling wines with celebrations has been strengthened over hundreds of years. For example, Napoleon's troops celebrated victories with sabrage, in which a bottle of Champagne is dramatically opened by striking the bottle with a saber or long knife. This strike not only removes the stopper, but also the top portion of the glass bottle's neck. Since the late 1800s, when a new boat or ship is officially launched to sea, a bottle of Champagne is smashed (i.e. dramatically opened) on the hull to "christen" the boat. Similarly, it is tradition for professional athletes (e.g. baseball players) to remove Champagne stoppers and shower their teammates with Champagne to celebrate important victories. Commercially, according to a recent study by The Nielsen Company™, there is a strong association of sales volume with official holidays (e.g. Christmas, New Years, Valentine's Day). In brief, sparkling wines have a long, rich and storied connection with celebrations and events (e.g. holidays, parties, personal milestones and victories) in the minds of customers, and stopper removal from the pressurized bottle is central to the excitement and celebration.

Although global sales of non-Champagne sparkling wines is growing (4% compound annual growth rate from 2003-2007), the industry sees a potential opportunity for further growth. While Champagne manufacturers typically enjoy strong brand identities and can command high prices per bottle, the non-Champagne sparkling wine market is relatively commoditized and driven by price. Non-Champagne sparkling wines only account for 45% of total market revenues even though almost 90% of all sparkling wine bottles that are sold are non-Champagne sparkling wines. Therefore, non-Champagne sparkling wine companies see long term potential in brand or product differentiation. Marketing, such as packaging innovation, was emphasized as a differentiation strategy in a September 2008 industry report (just-drinks/IWSR report, *Global market review of sparkling wine—forecasts to* 2012). According to a summary of the report: " . . . some marketers argue that the absence of innovation in packaging is one of the reasons for the relative dearth of strong non-Champagne sparkling wine brands, and that the time is right to break that mould and invest in new formats."

From a customer's perspective, because the ritual of drinking champagne is so tightly associated with celebrations and parties, it is common to buy sparkling wine for events even though the host and guests are not aficionados. There may be some interest while the stopper is removed from the sparkling wine bottle if the person opening the bottle seems inexperienced, then glasses are passed around and the party or event resumes. Therefore, there is a need for manufactures to develop an identity for their sparkling wines, and an opportunity may exist if the entertainment or celebratory spirit of an event were enhanced by packaging improvements. In particular, there is a need for packaging improvements that enhance the novelty of stopper removal and, thus, de-commoditize the non-Champagne sparkling wines.

Surprisingly, there has been little effort to enhance the novelty value of stopper removal from sparkling wines, even though the ritual has existed for centuries. In fact, most ideas are directed towards the notion that stopper removal is difficult or dangerous instead of an opportunity for safe entertainment. Furthermore, widespread customer adoption may be enhanced by customer control regarding whether a novelty item appears or not, as there may be a small subset of circumstances or settings in which a novelty item is not appropriate (e.g. when bottles must be opened in the commercial kitchen of a restaurant instead of in front of guests). In brief, there is a need for a simple, inexpensive, robust, effective and safe design that is amenable to industry adoption.

SUMMARY

Embodiments of the present invention provide a novelty item which may enhance the entertainment value associated with removing a stopper from a pressurized bottle. In one embodiment of the invention, a stopper and novelty item may be injected into a bottle of a beverage (e.g. sparkling wine, sparkling cider). The bottle may be pressurized (e.g. carbonated). Upon removal of the stopper, a novelty device may provide entertainment to the customer (e.g. host, honoree, attendee of an event). In another embodiment, a customer may determine whether a novelty item appears, based upon a selection of a method in which a stopper may be removed from a pressurized bottle.

With these and other advantages and features of embodiments that will become hereinafter apparent, embodiments may be more clearly understood by reference to the following detailed description, the appended claims and the drawings attached herein.

DETAILED DESCRIPTION

A number of terms are used herein for clarity and ease of exposition. For example, the term "sparkling wine" is used to refer to a wine with significant levels of carbon dioxide in it. The carbon dioxide can result from a method of natural addition (e.g. fermentation) and/or from artificial addition. The term "champagne" is used to refer to a type of sparkling wine that is produced in the Champagne region of France. The term "non-champagne sparkling wine" is used to refer to a sparkling wine that is not produced in the Champagne region of France.

The term "beverage" is used to refer to one or more of the following: a sparkling wine (e.g. Champagne or a Non-Champagne sparkling wine) or other alcoholic beverage (e.g. beer), a sparkling cider, soda, water or other non-alcoholic drink or similar drinks.

The term "bottle" is used to refer to a container for holding a beverage and may be made of glass or some other material (e.g. plastic or other polymer, metal, etc.) and may have a geometry that is either traditional for sparkling wines or has a modified geometry.

The term "event" is used to refer to an occasion or holiday in which a beverage is provided. The occasion may (but does not need to be) associated with something that is significant or celebratory (e.g. birthday, retirement, Thanksgiving, Independence Day, New Year's Eve, Romantic event, Valentine's Day, graduation, corporate event, thank you, weddings, engagement, political victory, sports victory, anniversary, Mother's Day, Father's Day, new baby, new grandchild, Zodiac significance, new home or boat purchase, Sold home, new job, inauguration, Christmas, an accomplishment, good luck in future, etc.).

The term "customer" is used to refer to a person who purchases, drinks, and/or is involved in opening and/or providing a beverage to attendees at an event. Alternatively and/or additionally, the customer may also be an attendee at the event.

The term "stopper" is used to refer to a closure device for a container, such as a Champagne cork, and the term "bottom of stopper" refers to the surface of the stopper that faces the beverage. The term "side of the stopper" refers to the cylindrical surface of the stopper that contacts and/or rests adjacent to the glass surface of the inside of the neck of the bottle.

The term "novelty item" is used to refer to one or more items of entertainment value that may be released upon removal of the stopper from the bottle.

Figure 1B:
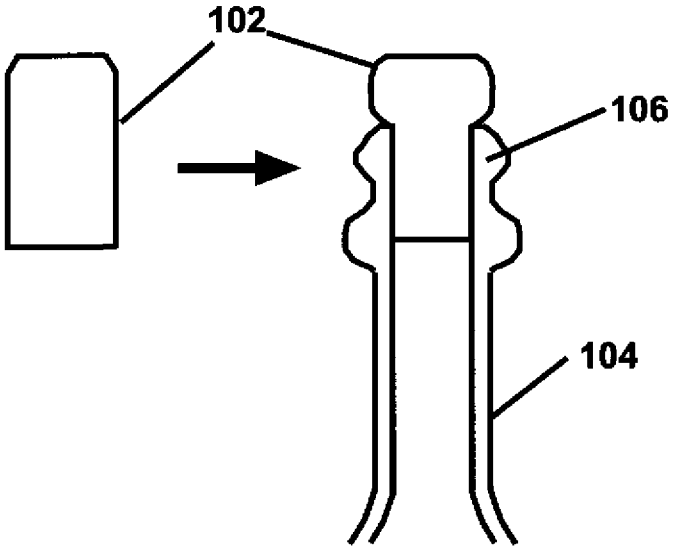
Fig. 1B (Prior Art)
FIGS. 1A-1B are side views of prior art stoppers.
Figure 1A:
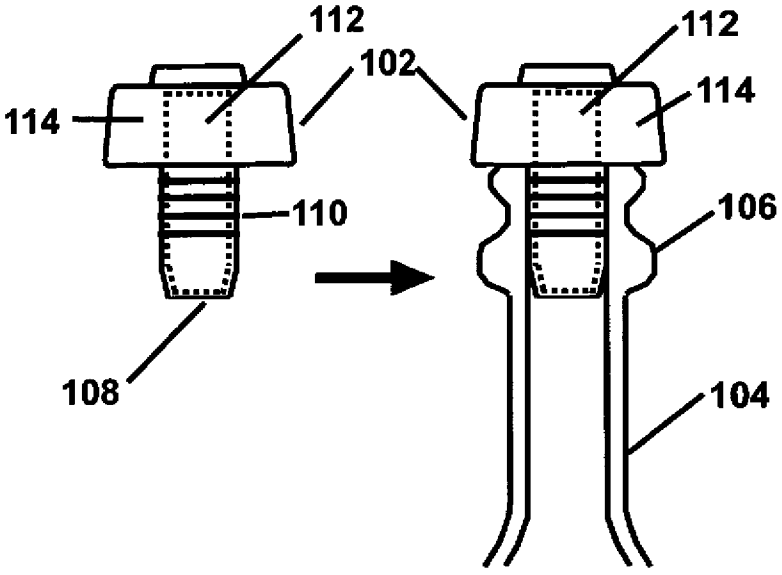
Fig. 1A (Prior Art)

Referring first to FIG. 1A, an illustration of an existing or prior art stopper is shown. FIG. 1A is a schematic that shows an example of a commercially available plastic stopper 102. The stopper 102 can be inserted into neck 106 of a bottle 104 by hand and, thus, is amenable for use even if a corking machine is not available. The dotted lines indicate a cylindrical, hollow region 112 inside the stopper 102. The stopper 102 has a mushroom-shaped portion 114 and a neck 110 which is inserted into the bottle 104.

FIG. 1B is a schematic showing an example of a commercially available stopper comprised of natural cork. The stopper 102 is typically inserted into the neck 106 of a bottle 104 with a corker machine. For example, the corker machine may squeeze the cork in a vice-like device, and then it may poke or press the cork into the bottle. In one embodiment, a stopper may be a hybrid in that it has an aesthetic natural cork outside region, and a hollow area inside of a rigid plastic sheath that preserves the geometry of the hollow area, in order to protect a novelty item during insertion and removal of the stopper from the bottle.

Embodiments of the present invention allow these types of stopper to be used with a novelty item to enhance enjoyment associated with a beverage. The schematics of FIG. 2 show how both styles of stopper may be inserted or configured to allow use with a novelty item pursuant to the present invention. For example, FIG. 2A is a schematic that shows one particular example of a stopper 202 according to the present invention. The mushroom-shaped portion 214 of the stopper 202 may be made of plastic or other material and may have a cylindrical, hollow region 212 formed inside the stopper 202 (e.g., extending from a bottom opening 208 of a neck 210 into the mushroom-shaped portion 214). A disk 216 formed of a material such as natural cork is rested proximate the bottom opening 208 by resting it on the circular rim of the stopper 202, at the entrance to the cylindrical, hollow region 218. The disk 216 is generally hockey puck-shaped and serves to seal a material or item (as discussed below) within the region 212. The stopper 202 is inserted into the neck 206 of a bottle 204 as normal, although the disk 216 is placed into the bottle 204 with the disk 216. In some embodiments, the disk 216 may be lightly or removably attached to the stopper 202 with a non-toxic adhesive or other material that allows the disk 216 to easily be inserted along with the stopper 202 while allowing the disk 216 to release from the stopper 202 when the stopper 202 is removed from the bottle 204.

Figure 2B:
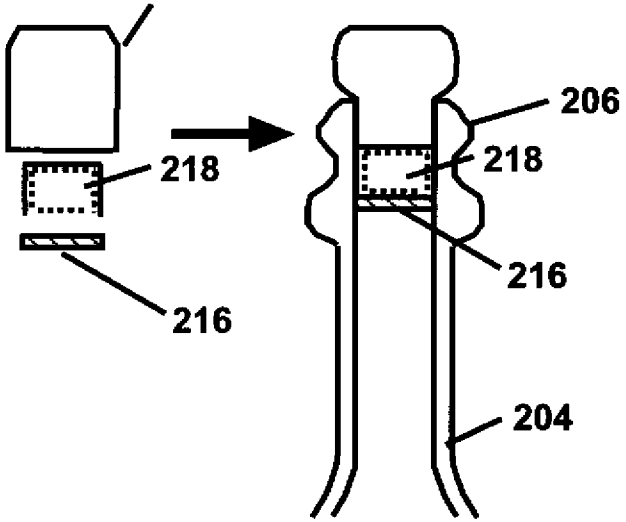
FIGS. 2A-2B are side views of stoppers pursuant to some embodiments.
Figure 2A:
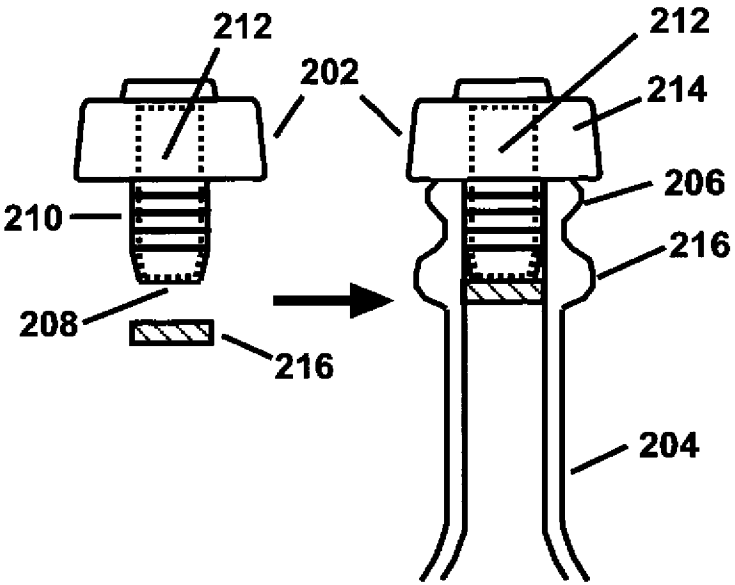

Referring now to FIG. 2B, a schematic is shown illustrating how a cork stopper 202 may be configured for use with embodiments of the present invention. The stopper 202 is comprised of a first portion that is natural cork (e.g. harvested from a Cork Oak tree), and a second portion of plastic 218 that has a cylindrical, hollow region denoted by dotted lines, and a third portion 216 that may be formed of a material such as natural cork and shaped like a hockey puck. The novelty item may be stored in the hollow region, and then the third portion 216 and second portion 218 may be inserted into the bottle 204 (by hand or machine). Then, the first portion may be inserted in a conventional manner via a corker machine. Upon cork removal, the novelty item may emerge from the hollow region.

The two styles of stopper design (shown in FIGS. 2A and 2B) may be used with novelty items in a variety of different ways. Examples will now be described by reference to FIGS. 3-8. The following examples are provided to clarify—but not limit the scope of—the invention.

Figure 3:
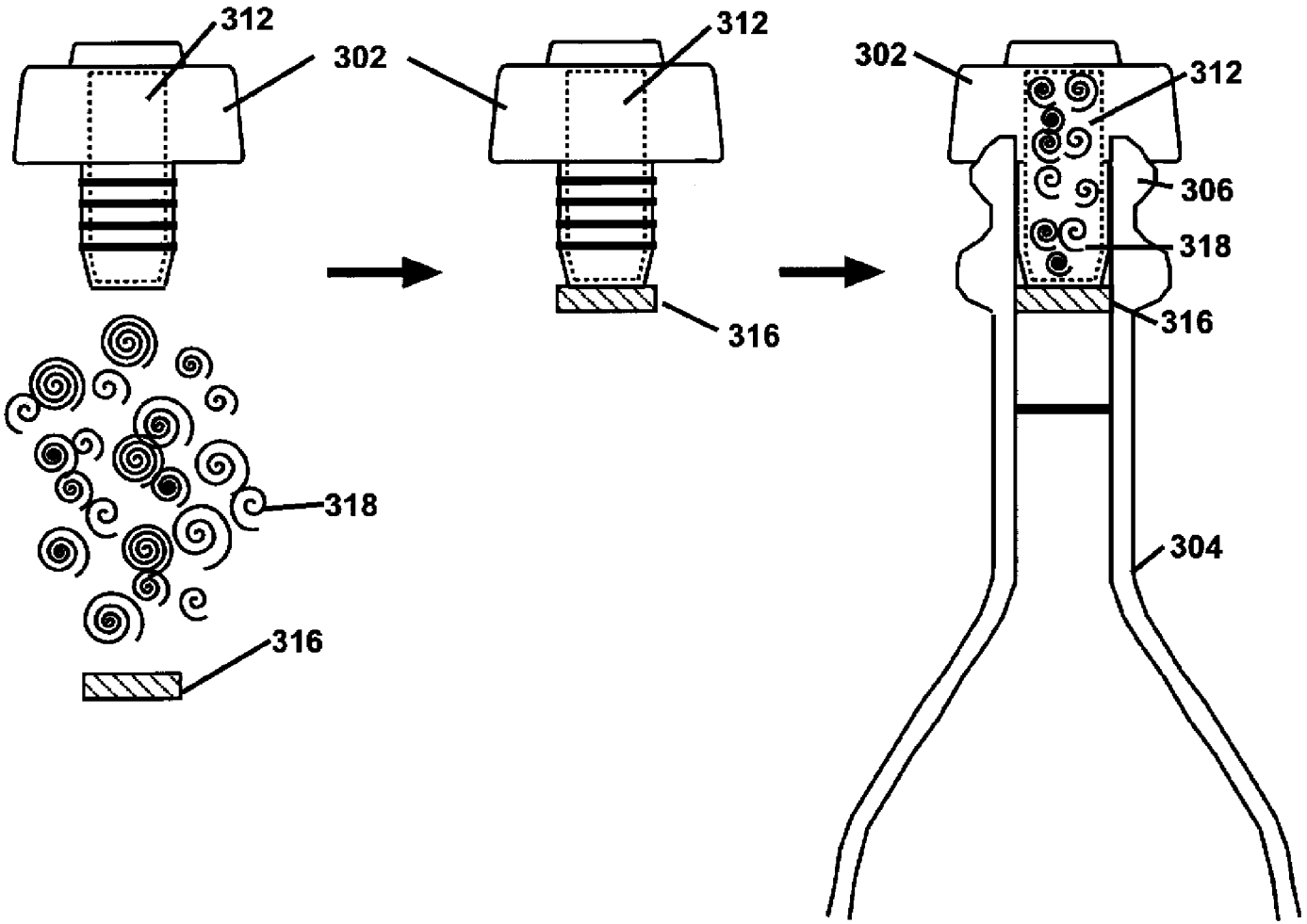
FIG. 3 is a side view of a novelty item pursuant to some embodiments.

In a first example, illustrated in FIG. 3, confetti or other material may be ejected during stopper removal. In one example, a plastic champagne stopper 302 that is commercially available is employed. The stopper 302 has a hollow, cylindrical region 312 that is open at the stopper's bottom. Such a stopper may be inserted by hand if a corker for sparkling wine is not available. The stopper is placed upside down and the hollow region is filled with biodegradable/edible confetti 318 through the opening at the stopper bottom. A cover 316 is positioned on top of the opening of the hollow region.

The novelty item (including the stopper 302, the confetti 318, and the cover 316) is flipped right-side up and inserted into a sparkling wine bottle 304 during disgorgement. The confetti 318 is trapped in the hollow 312 of the stopper 302, and is isolated from the beverage by the cover 316. The wire cage and foil are attached to the sparkling wine and it is sold to a customer or distributor.

In one example, a stopper is at least partially comprised of polyethylene. A novelty item (e.g. confetti) is placed in a hollow region of the stopper. An adhered cover (e.g. aluminum foil) is adhered to the stopper using heat to melt the polyethylene and create a bond with the adhered cover. The stopper (containing the novelty item and adhered to the adhered cover) is then inserted into a bottle of sparkling wine during disgorgement. The adhered cover isolates the sparkling wine from the novelty item and vice-versa. Air pressure in the hollow region increases after insertion due to carbon dioxide that passes through the polyethylene walls.

Figure 4:
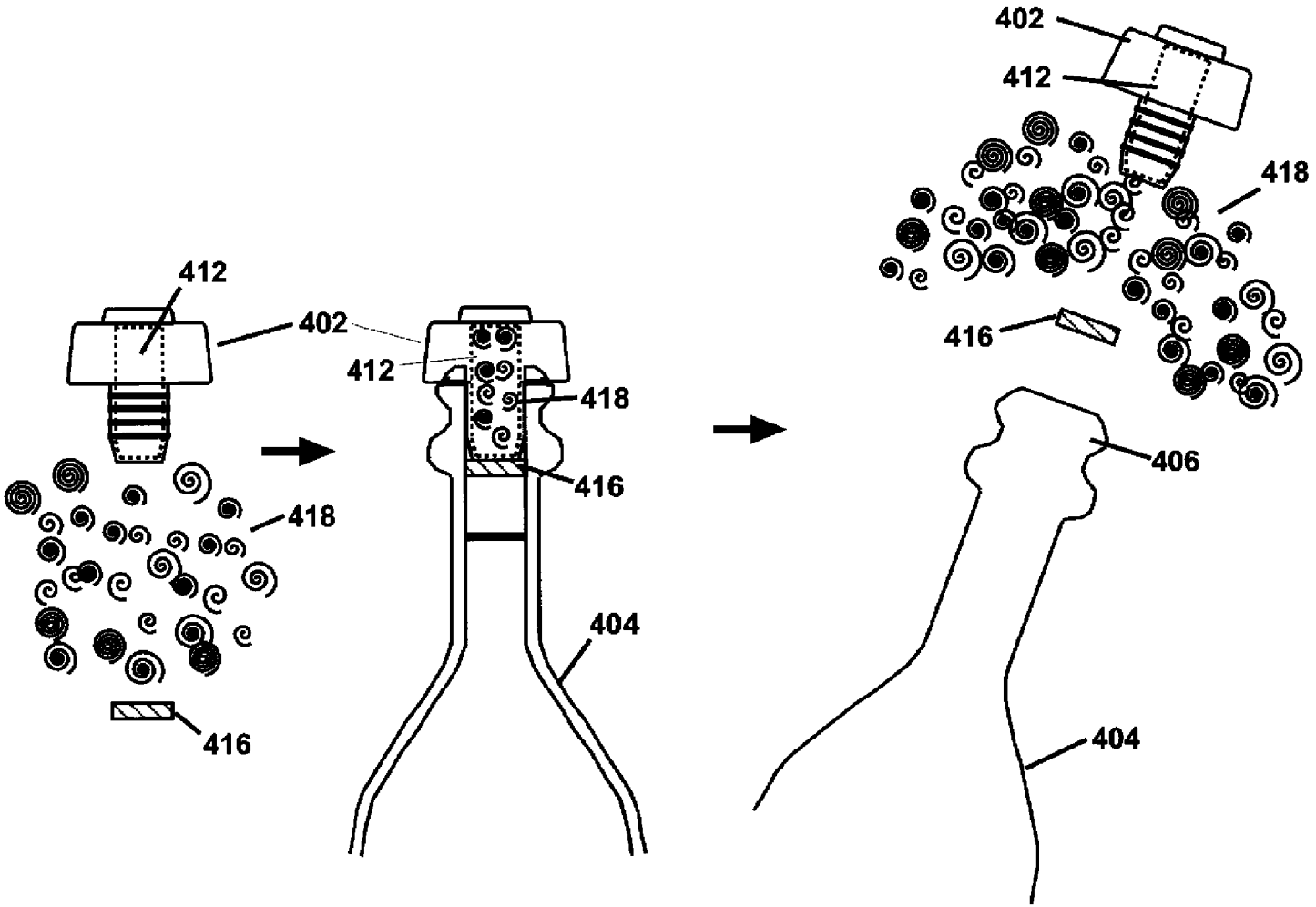
FIG. 4 is a side view of a further novelty item pursuant to some embodiments.

The customer buys the bottle of sparkling wine for her New Year's Eve party. At midnight of New Year's Eve, she removes the stopper 402 and, as it flies into the air, the pressure on the outside of the adhered cover relative to the inside of the adhered cover sufficiently decreases (i.e. a substantial pressure gradient develops across the cover), leading to emergence of confetti that bursts through the adhered cover. Her guests are lightly showered with confetti 418. Her guests are pleasantly surprised and the celebration is enhanced. The confetti is dry because the cover 416 prevented mixing of confetti 418 with sparkling wine. The removal of the stopper is illustrated in FIG. 4.

In a further example, a single glass of sparkling wine is ordered and the bottle is opened by a waiter in a busy restaurant kitchen. It is decided that confetti should not emerge in this setting, so the stopper is conventionally or slowly removed into the hand of the waiter. No confetti emerges as the pressure change on the outside of the adhered cover relative to the inside of the adhered cover is too gradual. Later in the evening, a full bottle of sparkling wine is ordered at a table and the waiter decides that confetti should emerge to entertain the dining party. The waiter pops the stopper into the air at the table, lightly showering the dining party with confetti.

In a still further example, an illustrative but not limiting example where both ribbon and confetti is ejected. In the illustrative example (shown in FIG. 5), a hollow region 520 is filled with ribbons 518. For example, the ribbons 518 may be folded back and forth in an accordion shape as they are placed into the hollow region 520. The accordion folding provides a slight elastic compression to the ribbon to enhance their ejection from the stopper after the stopper 502 is ejected from the bottle 504. Different shapes, colors and styles of confetti or ribbon may be placed within the hollow opening 520 and the novelty item may be selected based on the type of celebration. For example, for an independence day celebration, red, white and blue ribbons and star-shaped confetti may be used.

The disk 516 is rested on the ribbon-filled hollow region 520. After the resultant novelty item is flipped right-side up, the novelty item is inserted into the sparkling wine bottle 504. The bottle of sparkling wine is sold to a distributor and may then be purchased by the end customer. For example, the wine may be purchased from the distributor by a customer who is hosting an Independence Day party on July $4^{th}$. After a town fireworks display is over, guests come over to the party and the customer removes the stopper 502 from the bottle 504. As the stopper 502 is ejected, the ribbons and confetti 518 are ejected from the hollow region 520 as the disk 516 releases. Because the colored ribbons and stars represent elements of the United States flag, guests are excited and the celebratory spirit is enhanced. Then the sparkling wine is consumed.

A still further illustrative example will now be described by reference to FIGS. 6 and 7 where a parachute with a personalized message is ejected from a stopper of a bottle. In one embodiment, a hollow region 612 of a stopper 602 is filled with a parachute 618 that is tethered to the stopper 602 with string. The parachute 618 has a customized message 630 (shown in FIG. 6 as "Welcome Back, Class of '99, to Cornell!") printed on it. A disk 616 (e.g., made from a material such as cork or plastic) is placed on the rim of the hollow region 612, so that the parachute 618 is completely hidden on all sides by stopper or cork. After the resultant novelty item is flipped right-side up, the novelty item is inserted into the sparkling wine bottle 604. The bottle of sparkling wine is sold to a distributor.

The customer may be an end user or a group or entity (e.g., such as a caterer). In a specific illustrative example, the customer may be a caterer for Cornell University and the customer buys the sparkling wine from the distributor for a $10^{th}$ year reunion dinner event. After a speech by the president, waiters at each table pop the stopper from the sparkling wine bottles and the corks fly into the air. The disk and stopper separate in the air, parachutes fall out of the hollow region, and the corks are safely floated down with the parachutes. The champagne is poured for the alumni at each table. The parachute may be produced with different messaging, including offers or the like. For example, a parachute 718 with a message 730 revealing whether a person has won a sweepstakes is shown in FIG. 7.

Figure 8:
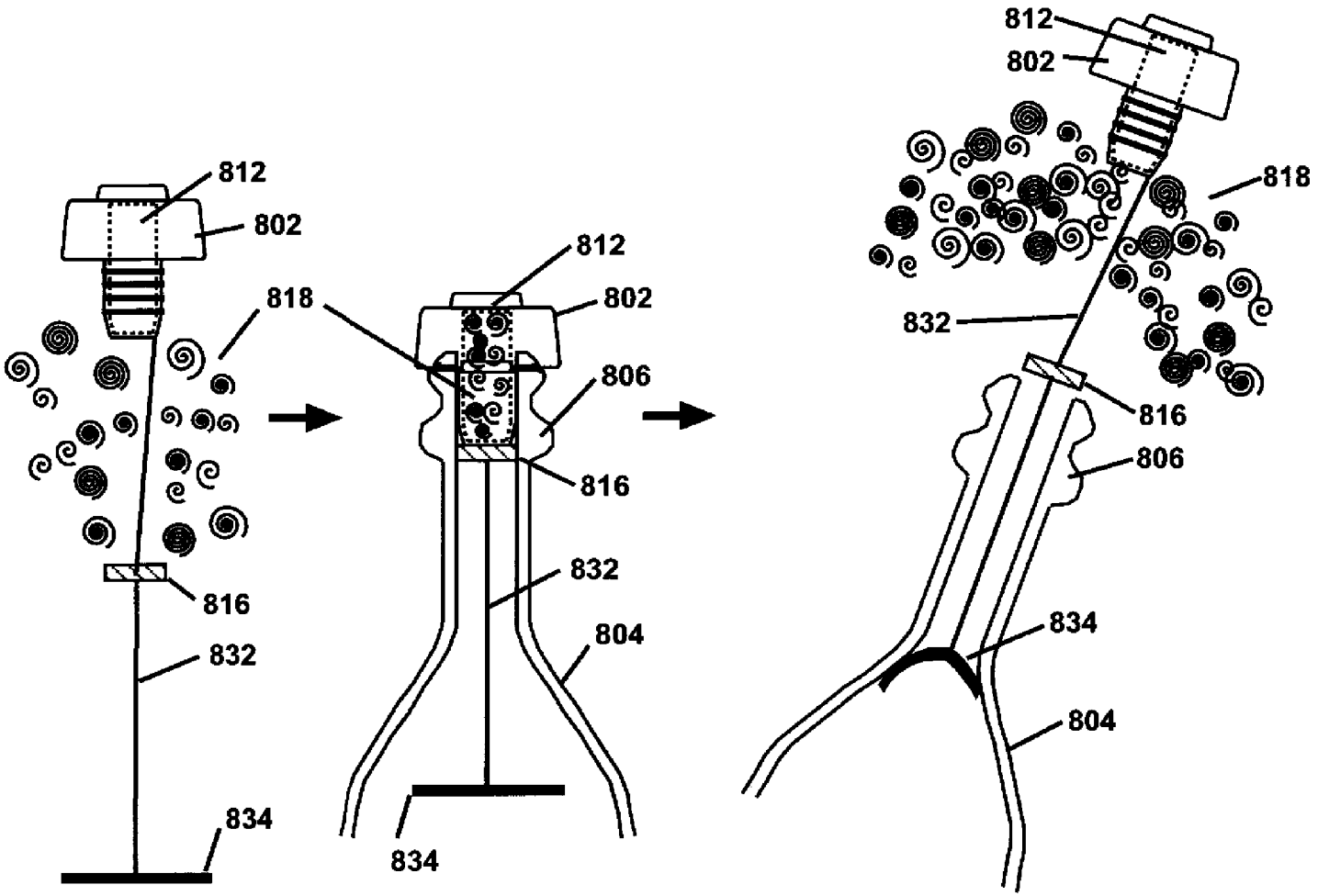
FIG. 8 is a side view of a further novelty item pursuant to some embodiments.

A still further example will now be described by reference to FIG. 8, where ejection of confetti 818 is shown in conjunction with a safety attachment 832. Similar to the example shown above in conjunction with FIG. 3 and FIG. 4, a stopper 802 is provided with confetti 818 or other material inside a hollow region 812. In the example of FIG. 8, a safety attachment 832 is incorporated into the novelty item for customers that are concerned about where the stopper 802 could land after flying out of the bottle 804. Confetti 818 is added into the hollow region 812 of the stopper 802, and one end of a wire is tethered to the back of the stopper. The wire is also tethered to the disk 816. The other end of the wire is tethered to a rectangular piece of plastic 834 (or other suitable material). The rectangular plastic 834 is shaped like a cylindrical rod. It is flexible and longer—but not wider—than the neck of the bottle 804. During disgorgement, the stopper 802 is inserted such that the confetti 818 is isolated between the stopper 802 and disk 816. The rectangular piece of plastic 834 is temporarily bent to insert it into the bottle 804, past the neck. Upon removal of the stopper 802, the stopper 802 may only travel the length of the tether 832 (e.g., such as 6 inches or so), before the tethered rectangular piece 834 contacts the narrow bottle neck and prevents further travel. The confetti 818 is ejected from the stopper at this point. Because the wire or stiff string has a bending or buckling rigidity, the stopper 802 does not reverse course and strike the customer (i.e. stopper and wire do not behave like the elastic tether and rubber ball of a paddle ball toy). Finally, because the rectangular piece 834 is long but narrow, its movement does not cause sparkling wine to splash out of the bottle 804.

Embodiments provide a number of advantages. For example, a beverage manufacturer or distributor may enjoy:

- Greatly increased entertainment value with minimal or no cost increases will help distinguish a sparkling wine brand from its competitors, in the eyes of the customer. Many customers take pride in the events that they host or contribute to, and they will purchase accordingly.
- Long-term branding. For example, the invention provides a means for sparkling wine manufacturers to offer unique benefits, even over Champagne sparkling wine.
- Branding through third party association. Novelty item may be associated with third party (e.g. sweepstakes for a new sports car), which may increase the prestige of the sparkling wine.

A customer purchasing and using bottles incorporating the present invention may enjoy benefits such as increased entertainment and enjoyment at parties or other events.

Other participants (such as third parties) may further enjoy an opportunity to associate with a sparkling wine, which itself is strongly associated with fun and celebration.

As discussed above, a number of different stopper designs or configurations may be used in conjunction with the present invention. For example, in one embodiment, the stopper comprises 1) a mechanism to close the beverage inside the bottle 2) a mechanism to maintain appropriate air pressure in the bottle when closed, 3) a mechanism to remove the stopper, and 4) a region for storing a novelty item until the stopper is removed. In a further embodiment, the stopper may also have a mechanism to isolate the novelty item from the beverage so that the novelty item does not get wet.

In order to facilitate incorporation by the sparkling wine industry, in one embodiment, certain aspects of a commercially available stopper may be—but are not necessarily—incorporated into the design of the stopper.

Referring again to FIG. 2, the stopper 202 may be comprised of one or more portions. In one embodiment, a hollow region 212 may exist for storage of the novelty item (e.g. confetti, ribbons, and/or a parachute). The novelty item may emerge from the hollow region (e.g. during cork removal and/or cork flight), and several possible means are envisioned for this emergence. In one embodiment, there may be a removable cover that isolates the novelty item from the sparkling wine and is positioned in any of a number of locations on the stopper. In a further embodiment, the cover may be positioned at or on the bottom of the stopper (i.e. parallel to and below the circular cross-section of the stopper). In another embodiment, the cover may be positioned on the cylindrical side of the stopper (i.e. adjacent to the inner surface of the glass bottleneck). For example:

Non-adhered cover: A cover 216 for the hollow region 212 that is not adhered or attached to the hollow region. The non-adhered cover may serve as a barrier that isolates the novelty item from sparkling wine or moisture and/or isolates the sparkling wine from the novelty item. The cover and hollow region separate during stopper removal or stopper flight, allowing for the emergence of the novelty item. In one example, a disk of cork, which sits between the sparkling wine and the novelty item/mushroom-shaped stopper component, is tethered by string to a sleeve that wraps behind the novelty item in the hollow region of the mushroom-shaped stopper component. After stopper removal and during flight, as the cork separates from the mushroom-shaped stopper component, the tether pulls the sleeve and novelty item out of the hollow region.

Adhered cover: A cover 216 for the hollow region that is adhered to or attached to the hollow region by any means known in the art (e.g. via a hinge, an adhesive, a press fit, welding or butt welding, a heat seal that adheres the cover to the hollow region, shrink wrap, a combination of one or more attachment means, etc.). The adhered cover may serve as a barrier that isolates the novelty item from sparkling wine or moisture (e.g. aluminum foil, plastic, or other material) and/or isolates the sparkling wine from the novelty item. The cover may open due to one or more of several possible mechanisms (e.g. due to loss of compression from the bottle neck upon cork removal—such as a spring-loaded, hinged door; e.g. due to the force applied to the cork by the pressurized beverage—such as peeling a thin cover from the hollow region during cork removal because the cover may be more tightly tethered to the bottle; e.g. due to a customer, who peels off the cover to reveal an engagement ring after stopper removal). In one embodiment, the adhered cover becomes non-adhered (e.g. peels away) during stopper removal, allowing for emergence of a novelty item. In another embodiment, the adhered cover remains adhered but breaks, ruptures, and/or tears, allowing the novelty item to emerge from the hollow region.

No cover: In one embodiment, the novelty item may be positioned between the stopper and the neck of the bottle.

In one embodiment, there may be a high air pressure in the hollow region relative to the ambient air pressure in a room at which an event may occur (e.g. 100 kPa). The high air pressure may be created and or maintained in the hollow region by any of several means known in the art. For example, plastic (e.g. polyethylene) is permeable to carbon dioxide, so the pressure inside a hollow region of a plastic stopper may increase after insertion into the sparkling wine bottle, due to carbon dioxide gas that enters from the high pressure sustained by the carbonated sparkling wine. In another example, the hollow region may be pressurized during manufacturing of the stopper and/or insertion of the stopper into the bottle. In a further embodiment, one or more of the following may be at least one contributor to emergence of the novelty item from the hollow region of the stopper:

a pressure difference between the hollow region inside the stopper and ambient air pressure the means or rate by which pressure changes outside the cover or disk upon removal from the high pressure carbonated environment (e.g. a stopper that is popped or propelled experiences a sharp pressure decrease upon removal, leading to emergence of the novelty item); (e.g. a stopper that is removed conventionally or gradually by restricting its flight and maintaining the stopper in the customer's hand or a hand-held towel experiences a more gradual pressure decrease upon removal, leading to no emergence of the novelty item).

In yet a further embodiment, if a stopper is configured such that the method of separation from the bottle determines whether a novelty item is revealed, the customer may determine whether confetti is appropriate at the point of opening a bottle instead of at a point of purchase. For example, if bottles must be opened in a commercial kitchen during preparation of a catered dinner (e.g. only a single glass is ordered), a waiter may decide that confetti is not to emerge. On the other hand, if an entire bottle is ordered at a table, the waiter may decide that confetti is appropriate.

In another embodiment, a hollow region may not be necessary. For example:

The novelty item remains embedded in or attached to the stopper 202 (e.g. light emitting diodes and/or a small audio speaker, as well as an electrical circuit).

The novelty item may be surrounded by stopper portions on top and bottom, and by the glass bottleneck on the sides.

The stopper 202 may fasten to the bottle 204 in a wide variety of methods, as is known in the field. For example:

Hand-insertion: Synthetic or polymer-based stoppers (e.g. plastic—injected and/or extruded) may be inserted by hand. In one embodiment, these stoppers may have one or more outer rings or nubs that press against the inside of the bottle neck due to insertion under compression (e.g. plastic hand-inserted stopper 202 such as shown in FIG. 2A).

Substantially compressed stopper: Plugging the hole with a compressed material as shown in FIG. 2B. The material may be natural cork, synthetic polymer or plastic.

bottle caps (e.g. crown cap)

screw caps (e.g. Stelvin caps)

plastic/glass seals (e.g. Vino-Seal)
Zorks
wire or wire cage
a combination of two or more of the above The stopper 202 may be fabricated from any of a variety of materials, as is known in the field. It is further envisioned that if the stopper has multiple portions or components (e.g. hollow cork and moisture barrier; e.g. such as shown in the embodiment of FIG. 2B), each particular portion may be comprised of one or more materials.

For example, the stopper may comprise:
Natural cork, which may be harvested from the Cork Oak tree and may be agglomerated, not agglomerated, or a combination (e.g. 1+1 wine corks)
Synthetic/alternative stoppers or corks
Synthetic polymer (e.g. plastic, polyethylene, polycarbonate, fluorinated ethylene-propylene (FEP), shrink wrap plastic)
glass
rubber
metal (e.g. bottle cap, aluminum foil as a moisture barrier and/or cover, Teflon as a moisture barrier)
etc.
Another natural material (e.g. another wood, wax, biodegradable material)
Glues, resins, or other adhesives
Substances to prevent adhesion
A combination of two or more of the above Materials for the stopper, one or more components of the stopper (e.g. hollow region, cover, disk, moisture barrier, stopper) may be selected or optimized for a variety of reasons or design criteria other than the novelty value. For example:
Oxygen permeability properties (e.g. layer of aluminum foil in the stopper)
Carbon dioxide permeability properties (e.g. permeability of plastic to promote ejection of novelty item)
Moisture barrier properties
Mechanical strength (e.g. materials that tear or break, permitting emergence of a novelty item)
Biodegradation
Ability to withstand pressure in bottle
Reproducibility
Production and/or packaging considerations
Ease of stopper removal or of safe stopper removal for customer
Marketing concerns (e.g. materials that do not alter taste of beverage)
Resemblance or lack of resemblance to a commercially available stopper
Materials approved by an agency (e.g. United States Food and Drug Administration)
Design approved by an agency (e.g. a group or organization associated with sparkling wine or Champagne)

The stopper 202 may be inserted into the bottle 204 in any of a variety of methods, as is known in the field, whether the method is currently commercially available or not. For example, the stopper may be inserted by hand, with the aide of a small machine (e.g. hand corker), or with the aide of a large machine (e.g. floor corker). Stopper insertion may occur at any point during or after the process of fabrication of the beverage (e.g. sparkling wine). For example:
insertion into the bottle during the disgorgement process of sparkling wine production.
inserted into the bottle after the disgorgement process
insertion during the process of first introducing the beverage into the bottle
etc.

Figure 5:
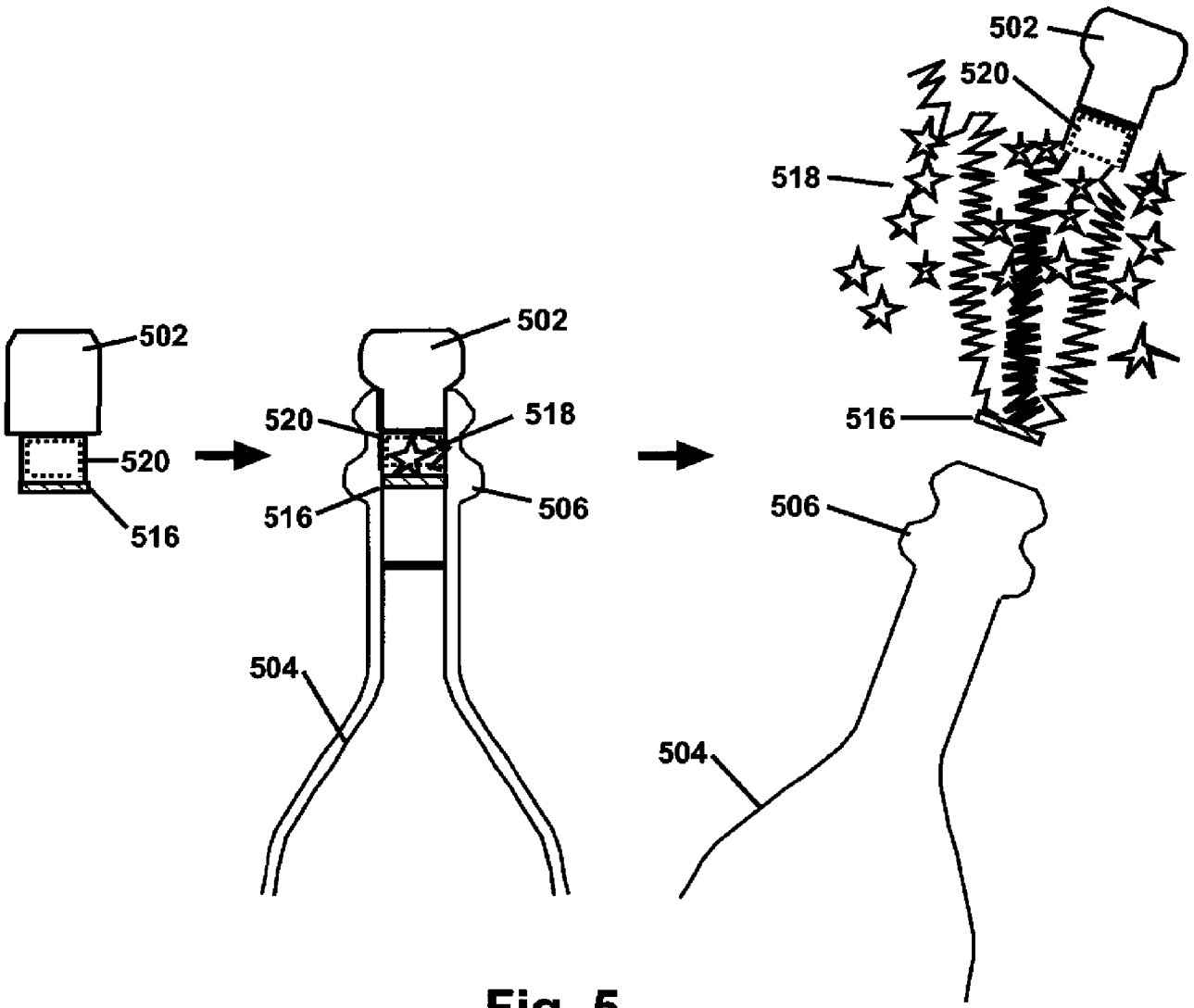
FIG. 5 is a side view of a further novelty item pursuant to some embodiments.

The novelty item provided within the hollow region 212 (or 218) may be any of a number of different items. For example, the novelty item may be:
Confetti (as shown in FIG. 3, 4 or 8)
Ribbons (as shown in FIG. 5)
A parachute (as shown in FIGS. 6 and 7)
Light stimulation (e.g. a light emitting diode that becomes lit or blinks in association with cork removal)
Auditory stimulation
(e.g. a circuit and speakers that provide sound effects and/or an announcement)
A small explosive charge (e.g. a party popper or party snaps; the novelty item may comprise the charge and/or the stopper may comprise the charge).
A message or note. (e.g., such as on a parachute as shown in FIGS. 6 and 7, or on other materials) For example, a message that is associated with a sweepstakes. For example, a message that provides an entertaining fortune for the New Year.
A propeller
A combination of one or more of the above (e.g. ribbons and confetti—as shown in FIG. 5)

The design of the novelty item may comprise one or more of the following:
Synthetic material (e.g. plastic) and/or natural material (e.g. wood-based paper)
Edible (e.g. sugar-based confetti or cake sprinkles) or non-edible (e.g. metal)
Biodegradable (e.g. biodegradable confetti or ribbons) or non-biodegradable
Animal safe or not (e.g. rice ingestion can harm some birds)
Color, luminescence (or not), shape, size, extent of reflectivity (e.g. glittery material)
Toxic or non-toxic (e.g. US Food and Drug Administration grade materials)
The behavior of the novelty item during cork removal and/or cork flight
The time duration of "floating" in the air before reaching the ground
The behavior of the novelty item while in the air (e.g. twirling, spinning)
How long it takes for a parachute to open and/or slow a stopper
Ease of cleanup
Designs that enhance surprise, fun or entertainment
A keepsake (e.g. an engagement ring, a necklace)

In one embodiment, the novelty item may be personalized or associated with a characteristic of the event and/or the customer (e.g. event host, honoree, and/or attendee).

For example:
Confetti that spells the phrase: "Happy New Year!" emerges upon opening a bottle on New Year's Eve.
Ribbons printed with the word: "Congratulations!" burst out for a victory, graduation, accomplishment, or retirement.
Red, white and blue ribbons plus white, star-shaped confetti to symbolize the United States flag is the novelty item associated with independence day parties (Refer to FIG. 5)
In order to improve the spirits of children during Thanksgiving, who are not allowed to drink alcoholic beverages, sparkling cider is provided to the children. Multicolored confetti shaped like turkeys is released.
Red confetti that are shaped like socks burst into the air upon opening a bottle in a locker room celebration of the Red Sox after they win the pennant.

Figure 6:
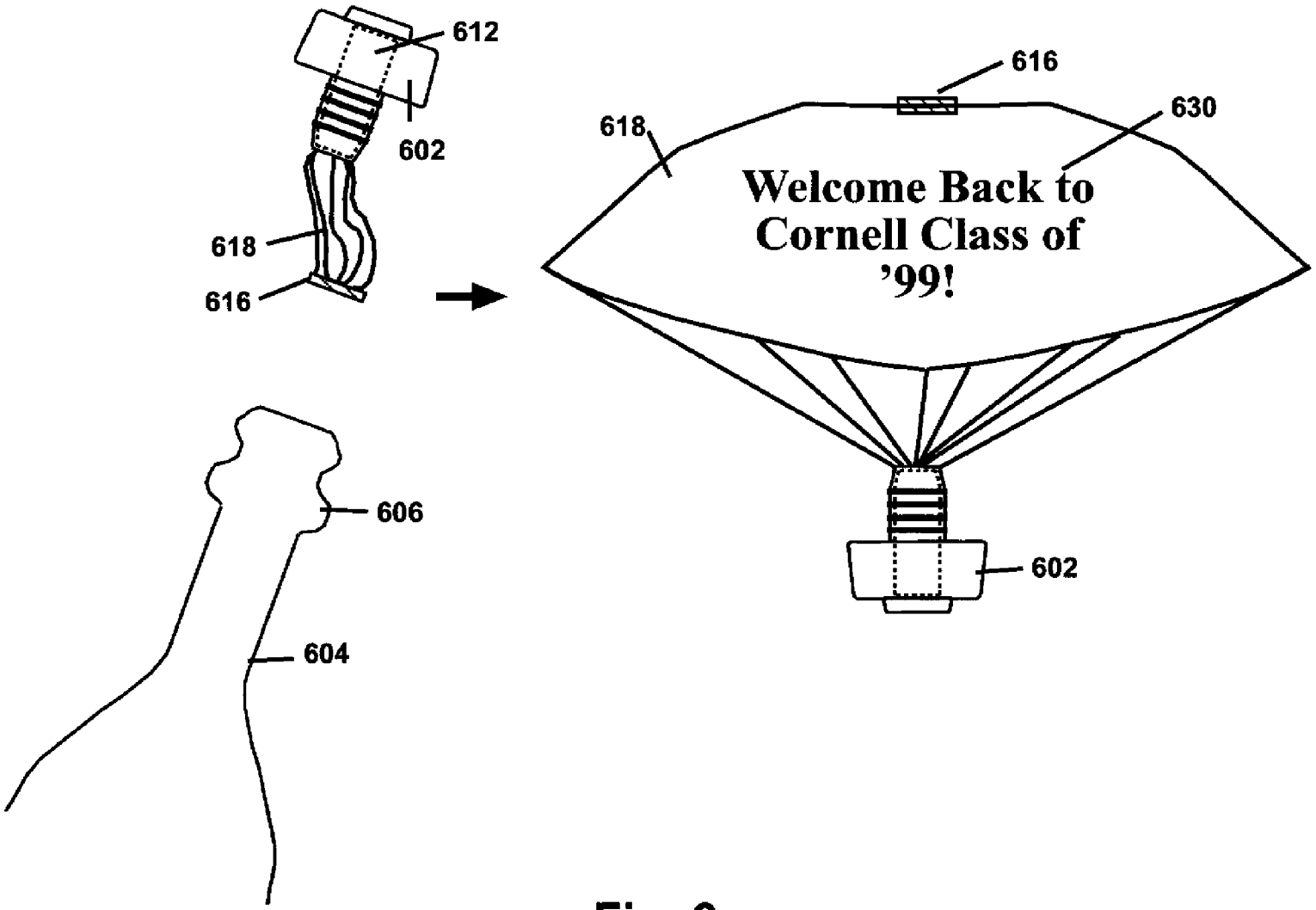
FIG. 6 is a side view of a further novelty item pursuant to some embodiments.
Figure 7:
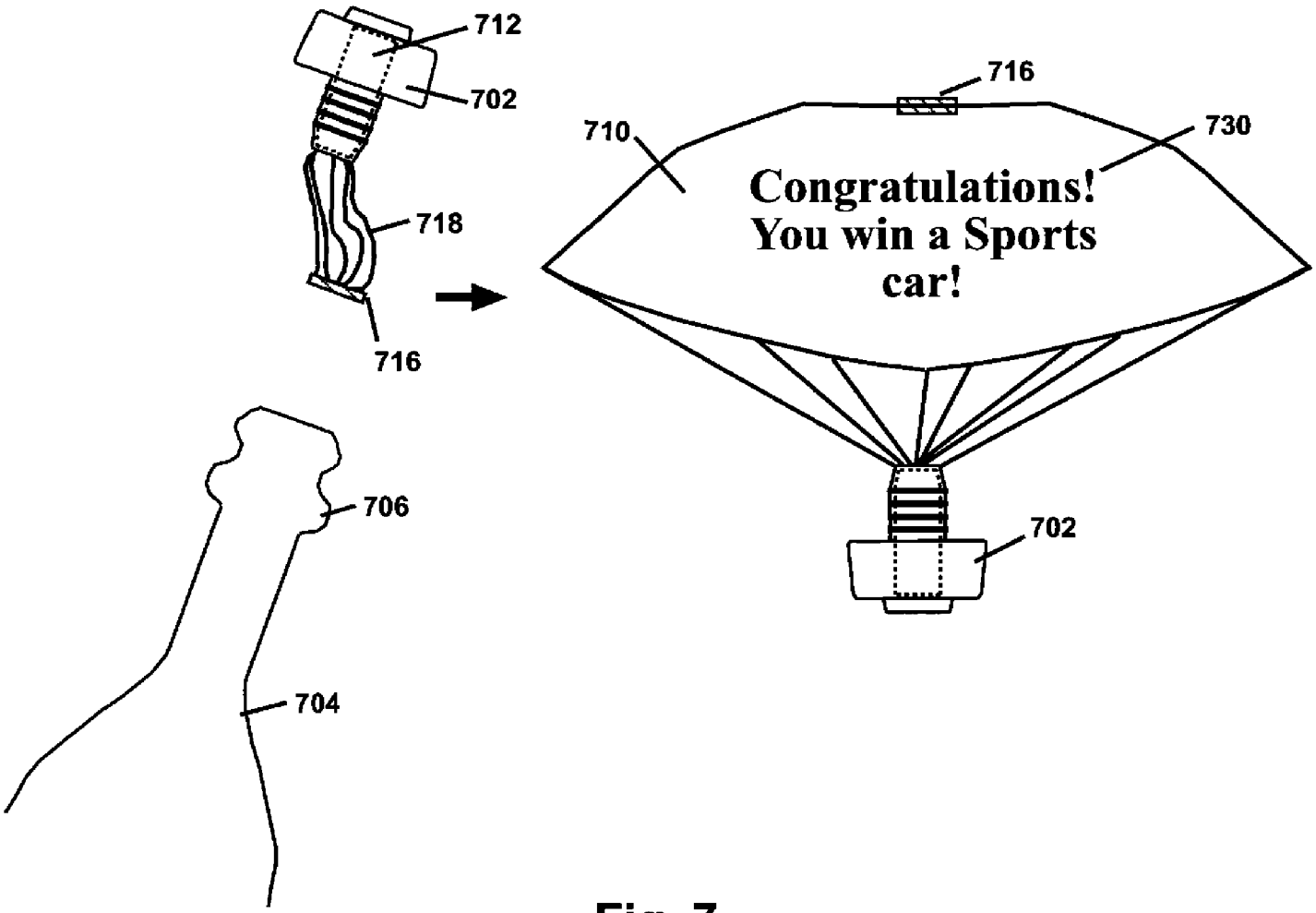
FIG. 7 is a side view of a further novelty item pursuant to some embodiments.

Images of a victorious presidential candidate may be printed onto confetti for an inauguration day celebration A parachute message greets attendees at an undergraduate alumni reunion (Refer to FIG. 6)

A photo of a husband and wife are printed onto a parachute for an anniversary

An audio speaker attached to the cork or bottle may ask: "Jane, will you marry me?" Furthermore, an engagement ring may be removed from the hollow of the stopper upon stopper removal.

A note may provide information regarding a sweepstakes (e.g. "you won $1000)

The novelty item may be rose petals, in association with Valentine's Day.

In one embodiment, the novelty item may be associated with a third-party. For example, a particular brand of sparkling wine may be associated with Lexus in order to enhance the perceived prestige of the sparkling wine and the perceived fun and excitement of driving a Lexus. A sweepstakes may be associated with the novelty item, in which the winner is notified via a message on the parachute of the stopper. An example is illustrated in FIG. 7.

Pursuant to some embodiments, there is an increased pressure inside the closed (i.e. stoppered) bottle 204 relative to outside the bottle. This increased pressure may result from any of a variety of mechanisms as is known in the art. For example:

Carbon dioxide gas produced by yeast during fermentation (e.g. conditioning)

Carbon dioxide gas injected into bottle or added to beverage in an artificial or non-biological process (e.g. addition of carbon dioxide to a liquid under pressure)

Carbon dioxide gas produced by another organism and/or another chemical process (e.g. sodium bicarbonate mixed with citric acid)

Another gas that accumulates in the bottle due to a biological or non-biological process (e.g. nitrogen gas mixed with Guinness Stout)

The stopper 202 may be removed according to any method, whether it is currently, commercially available or not (e.g. by hand, with the aide of champagne pliers or a machine, etc.). In one embodiment, the stopper 202 may be removed so that it flies or sails into the air, due to the increased pressure. Further, a novelty item (e.g. confetti, ribbons, parachute, etc.) may emerge from the stopper 202 during removal and/or flight of the stopper. In another embodiment, the stopper may be prevented from flying in the air (e.g. if novelty item is a valuable engagement ring), by a hand, towel, machine, etc.

In one embodiment, the initial velocity of the stopper 202 at the beginning of the flight of the stopper, may be decreased or increased to improve the entertainment. For example, one or more of the following methods may be employed:

Increase pressure in the bottle (e.g. more carbon dioxide)

Decrease the cross-sectional area to which the force is applied to the stopper (e.g. by incorporating a collar that is not removed upon removal of stopper, which effectively narrows the bottle neck; e.g. narrow the bottle neck by increasing the thickness of glass in the bottle neck)

Changing the shape or properties of the stopper (e.g. to change aerodynamical properties of stopper in the front and/or back).

In one embodiment, the emergence of the novelty item from the stopper 202 is carefully controlled. For example:

Confetti may be released through a narrowed opening at the bottom of the stopper so that it is released over a longer period of time.

A spring may quickly eject a parachute from the back of the stopper to more effectively slow down the stopper.

The bottom of the stopper may be sealed with a thin plastic layer to protect an engagement ring. The plastic layer may read "Yes, I will marry you!" and, upon removal, may reveal the engagement ring.

In one embodiment, it may be desirable to control or limit the possibility of flight for the stopper 202. This may be useful in order to market enhanced safety alongside enhanced entertainment value. There are many inventions or mechanisms known in the art for controlling or limiting the flight of the stopper, and it is anticipated that one or more of these may be incorporated into the invention. Alternatively or additionally, an example of a mechanism to control the flight of the stopper is shown in FIG. 8. A thin, plastic, cylindrically-shaped rod is tethered to the portions of the stopper via a connection (e.g. wire, plastic, etc.) that has a nontrivial compressive strength. The rod may be inserted into the bottle during insertion of the stopper. Upon stopper removal, the stopper initially flies into the air, but is stopped by the tethered rod, which is wider than the bottleneck. Because the tethering connection has a compressive strength, recoil (e.g. striking the customer who removes the stopper; splashing of the beverage) is prevented. The novelty item may emerge during or after the removal of the stopper. The rod may be pulled out of the bottle before pouring the beverage, or it may be poured around the rod, which does not substantially occlude the opening of the bottle neck. The stiffness of the rod, the length of the tethers, the means of adhering the components, and the compressive and tensile strength of the tethering connection may be selected to optimize length of flight of the stopper, lack of recoil, and/or enhanced release of the novelty item.

The present invention has been described in terms of several embodiments solely for the purpose of illustration. Persons skilled in the art will recognize from this description that the invention is not limited to the embodiments described, but may be practiced with modifications and alterations limited only by the spirit and scope of the appended claims.

I claim:

1. A stopper for use as a closure device for a bottle having a neck, the stopper comprising:

a body having a top portion, a lower surface, and defining an inner chamber;

a novelty item disposed within said inner chamber;

a cover, coupled to a bottom surface of said body opposite said top portion to removably hold said novelty item within said inner chamber;

said stopper being a moisture barrier;

at least one of said body and said cover being configured to provide gas exchange between said inner chamber of said stopper and an interior of a bottle when the stopper is inserted in the neck of the bottle allowing for pressure equilibration of said inner chamber of said stopper with a pressure inside said bottle; and said cover being configured to open upon removal of the stopper from a neck of a bottle in response to a pressure disequilibration across said cover for revealing said novelty item.

2. The stopper of claim 1, wherein the body is formed of at least one of a plastic material and cork.

3. The stopper of claim 1, wherein said novelty item comprises at least one of (i) confetti, (ii) ribbons, (iii) a parachute, (iv) a ring, (v) a propeller, (vi) a message, (vii) a noisemaker, a light, and (viii) a gift item.

4. The stopper of claim 1, wherein said body is shaped to fit within a neck of a bottle.

5. The stopper of claim 1, wherein said body and said cover are shaped to fit within a neck of a bottle.

6. The stopper of claim 1, wherein:

the inner chamber is configured to be inserted into the neck of the bottle with the top portion configured to remain exterior to the neck of the bottle.

7. The stopper of claim 6, wherein the body is formed of at least one of a plastic material, and cork.

8. The stopper of claim 6, wherein said novelty item comprises at least one of (i) confetti, (ii) ribbons, (iii) a parachute, (iv) a ring, (v) a propeller, (vi) a message, (vii) a noisemaker, a light, and (viii) a gift item.

9. The stopper of claim 6, wherein said inner body and said cover are shaped to fit within a neck of a bottle.

10. The stopper of claim 6, wherein said cover is formed of a material comprising at least one of aluminum foil, metal foil, a polymer, and a plastic.

11. The stopper of claim 1, wherein the cover is adhered to the body by one or more of (i) glue, (ii) resin, (iii) heat sealing, (iv) hinge, (v) press fit, (vi) adhesive, (vii) welding, (viii) butt welding, and (ix) shrink wrap.

12. The stopper of claim 1, wherein the cover comprises at least one of aluminum foil, plastic, a polymeric material, and metal foil.

13. The stopper of claim 1, wherein the pressure disequilibration gradient is only sufficient to remove the cover if a flight of the stopper is unrestrained upon separation of the stopper from the bottle.

14. The stopper of claim 1 further comprising a tether coupled to the body for restricting a flight of the stopper when the stopper is removed from the neck of a bottle.

15. A stopper for use as a closure device for a bottle having a neck, the stopper comprising:

a body having a top portion, a side surface, and defining an inner chamber open to said side surface;

a novelty item disposed within said inner chamber; and a cover, removably coupled to said side surface for closing said inner chamber to removably hold said novelty item within said inner chamber;

said stopper being a moisture barrier;

at least one of said body and said cover being configured to provide gas exchange between said inner chamber of said stopper and an interior of a bottle when the stopper is inserted in the neck of the bottle allowing for pressure equilibration of said inner chamber of said stopper with a pressure inside said bottle;

said cover being configured to open upon removal of said stopper from a neck of a bottle in response to a pressure disequilibration across said cover for revealing said novelty item.

16. The stopper of claim 15 wherein the pressure disequilibration gradient is only sufficient to remove the cover if a flight of the stopper is unrestrained upon separation of the stopper from the bottle.

17. The stopper of claim 15 further comprising a tether coupled to the body for restricting a flight of the stopper when the stopper is removed from the neck of a bottle.

* * * * *